US011760051B2

(12) United States Patent
Buffa et al.

(10) Patent No.: US 11,760,051 B2
(45) Date of Patent: Sep. 19, 2023

(54) EMBOSSING GROUP WITH INTERCHANGEABLE ROLLERS

(71) Applicant: GAMBINI S.P.A., Milan (IT)

(72) Inventors: Giovanni Buffa, Ponte Buggianese (IT); Fabio Picchi, Lammari (IT); Paolo Lazzareschi, Lucca (IT)

(73) Assignee: GAMBINI S.P.A., Milan (IT)

( * ) Notice: Subject to any disclaimer, the term of this patent is extended or adjusted under 35 U.S.C. 154(b) by 0 days.

(21) Appl. No.: 17/711,210

(22) Filed: Apr. 1, 2022

(65) Prior Publication Data

US 2022/0314571 A1 Oct. 6, 2022

(30) Foreign Application Priority Data

Apr. 6, 2021 (IT) ..... 102021000008501

(51) Int. Cl.
*B31F 1/07* (2006.01)

(52) U.S. Cl.
CPC ..... *B31F 1/07* (2013.01); *B31F 2201/0728* (2013.01); *B31F 2201/0753* (2013.01); *B31F 2201/0776* (2013.01); *B31F 2201/0784* (2013.01)

(58) Field of Classification Search
CPC ..... B31F 1/07; B31F 2201/0728; B31F 2201/0753; B31F 2201/0776; B31F 2201/0784
See application file for complete search history.

(56) References Cited

U.S. PATENT DOCUMENTS

| | | | | |
|---|---|---|---|---|
| 6,109,326 A * | 8/2000 | Leakey | B31F 1/07 | 156/219 |
| 6,675,707 B1 * | 1/2004 | Heiler | B41F 23/08 | 101/247 |
| 6,688,366 B1 * | 2/2004 | Gambini | B31F 1/07 | 156/582 |
| 2001/0029853 A1 * | 10/2001 | Weishew | B41F 5/24 | 101/477 |
| 2008/0229958 A1 * | 9/2008 | Catelli | B31F 1/07 | 101/479 |

(Continued)

FOREIGN PATENT DOCUMENTS

| | | |
|---|---|---|
| CN | 110696437 A | 1/2020 |
| EP | 1074382 A1 | 2/2001 |

OTHER PUBLICATIONS

Search Report and Written Opinion dated Dec. 14, 2021 in Italian Patent Application No. 102021000008501, 9 pages.

*Primary Examiner* — David H Banh
(74) *Attorney, Agent, or Firm* — Element IP, PLC

(57) ABSTRACT

An embossing group with interchangeable rollers for the surface processing of tissue paper comprises a frame (13) bearing three pairs of steel embossing rollers (17), each pair being movable between a first operative position for embossing two paper plies (11, 12) and rest positions, as well as it comprises two rubber-coated rollers (19, 20) which can be coupled with the pair of embossing rollers (17) placed in the operative position, and it further comprises two pairs of rotating supports (14, 15), wherein each one is provided with three arms (16), each one bearing at the end a locking element (18) for one end of an embossing roller (17), the rotating supports (14, 15) being constrained to the frame (13) rotating around their own central axis.

11 Claims, 2 Drawing Sheets

(56) References Cited

U.S. PATENT DOCUMENTS

| | | | | |
|---|---|---|---|---|
| 2012/0227595 | A1* | 9/2012 | Gambini | B31F 1/07<br>100/172 |
| 2017/0028666 | A1* | 2/2017 | Montagnani | B32B 37/12 |
| 2017/0355165 | A1* | 12/2017 | Gambini | D21F 11/08 |

* cited by examiner

EMBOSSING GROUP WITH INTERCHANGEABLE ROLLERS

The present invention relates to an embossing group with interchangeable rollers.

It is well known to couple several plies of so-called "tissue" paper, usually two or three plies, by means of an embossing group to make multi-ply laminated tissue rolls, either toilet paper or kitchen paper, through a so-called embossing and laminating process. On each of the paper plies, protuberances, called embossings, are obtained at one or more heights or micro-embossings, by passing between a pair of steel/rubber embossing rollers.

It is also known that, close to one of the two pairs of steel/rubber rollers, a glue dispenser may possibly be associated which will apply adhesive to one of the plies at at least part of the embossings.

The plies provided with adhesive are then laminated by means of pressure exerted by a coupling roller, the so-called marriage roller, which couples the plies provided with adhesive.

The term micro-embossing means that the paper plies are embossed by means of a micro-embossing roller, and the related counter cylinder, which has reliefs substantially equally distributed on its side surface, where the reliefs have heights generally less than half a millimetre. Micro-embossing is therefore distinguished from traditional embossing as generally understood, which employs embossing rollers that have reliefs of heights greater than half a millimetre and generally presenting designs that also have an aesthetic effect.

The decorations obtained on the two plies are used to obtain a product with a particular appearance, requested by the specific customer.

There is therefore a need to have available steel rollers bearing decorations of different designs depending on the batches of finished paper product that the various customers may request.

It is therefore necessary to replace in the embossing group a steel cylinder roller or a pair of steel rollers bearing a certain design with others of a different design. This replacement involves time-consuming disassembly and reassembly operations and the storage of spare rollers.

A solution to the complexity of steel roller replacement operations was proposed by EP1074382A1, in which three pairs of steel embossing rollers are arranged at the ends of three arms of a rotating star, so that at each rotation of the star one pair of embossing rollers is in the working position facing two respective rubber-coated rollers and the other two pairs of steel rollers are in rest positions.

This solution allows having three different pairs of steel embossing rollers that can be phased with each other and can therefore be used to emboss three different tissue products in phase, for example kitchen towel paper. A major drawback is the sizing of the support star, which has long arms burdened by a high weight consisting of two steel rollers for each arm. In addition, if one of the arms does not bear rollers, the support star is unbalanced due to the weight distribution.

The object of the present invention is to provide an embossing group with interchangeable rollers which solves the drawbacks of the prior art.

Another object of the present invention is to provide an embossing group with interchangeable rollers suitable for accommodating three pairs of embossing rollers which can be phased with each other.

A further object is to provide a compact and balanced embossing group with interchangeable rollers, suitable to be installed even with at least one empty roller station.

Another object of the present invention is to provide a particularly simple and functional embossing group with interchangeable rollers at a low cost.

These purposes according to the present invention are achieved by providing an embossing group with interchangeable rollers as set out in claim 1.

Further features are comprised in the dependent claims.

The features and advantages of an embossing group with interchangeable rollers according to the present invention will be more apparent from the following description, which is to be understood as exemplifying and not limiting, with reference to the schematic attached drawings, wherein.

Figure 1:
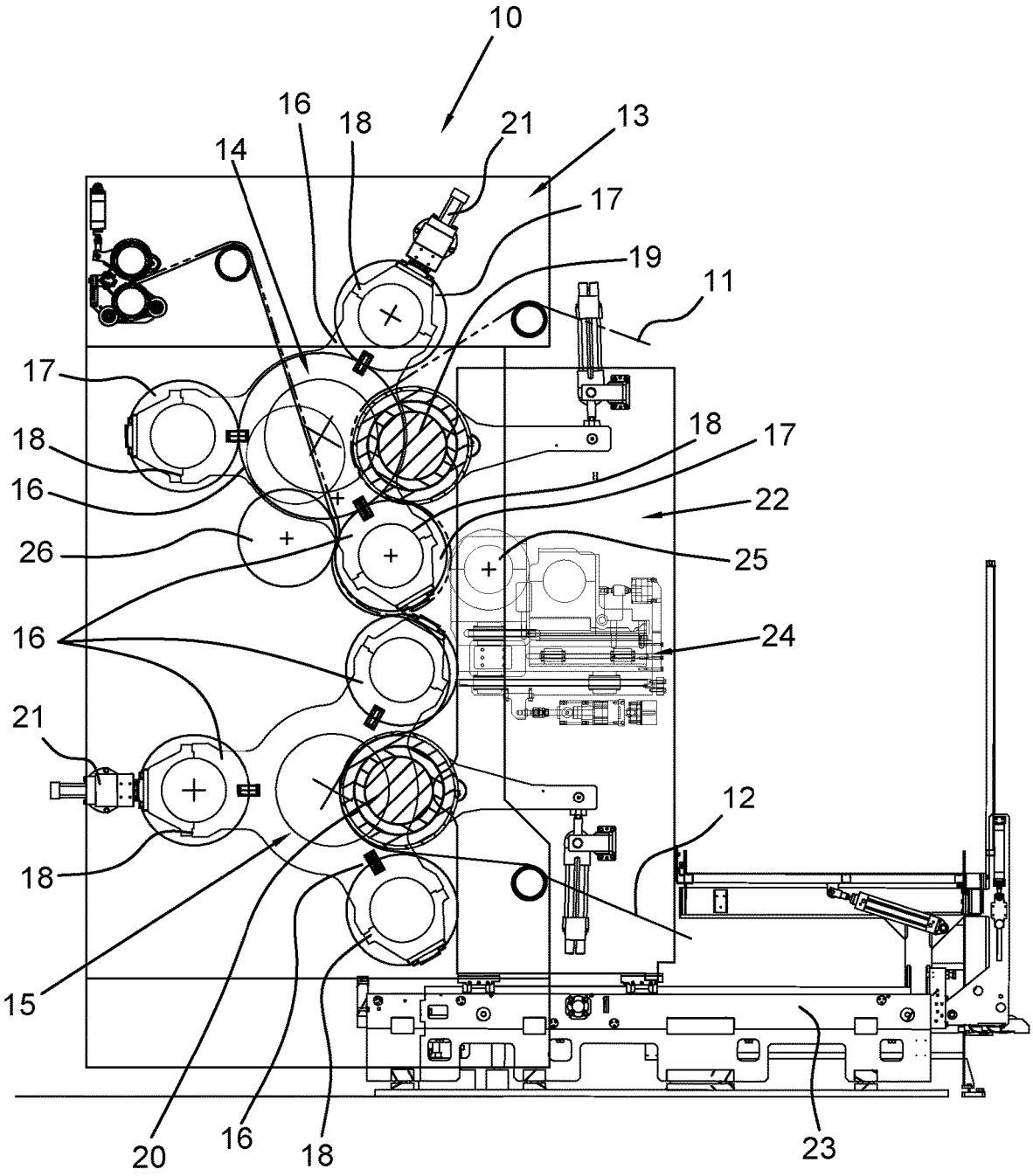
FIG. 1 shows an embossing group with interchangeable rollers according to the present invention.
Figure 2:
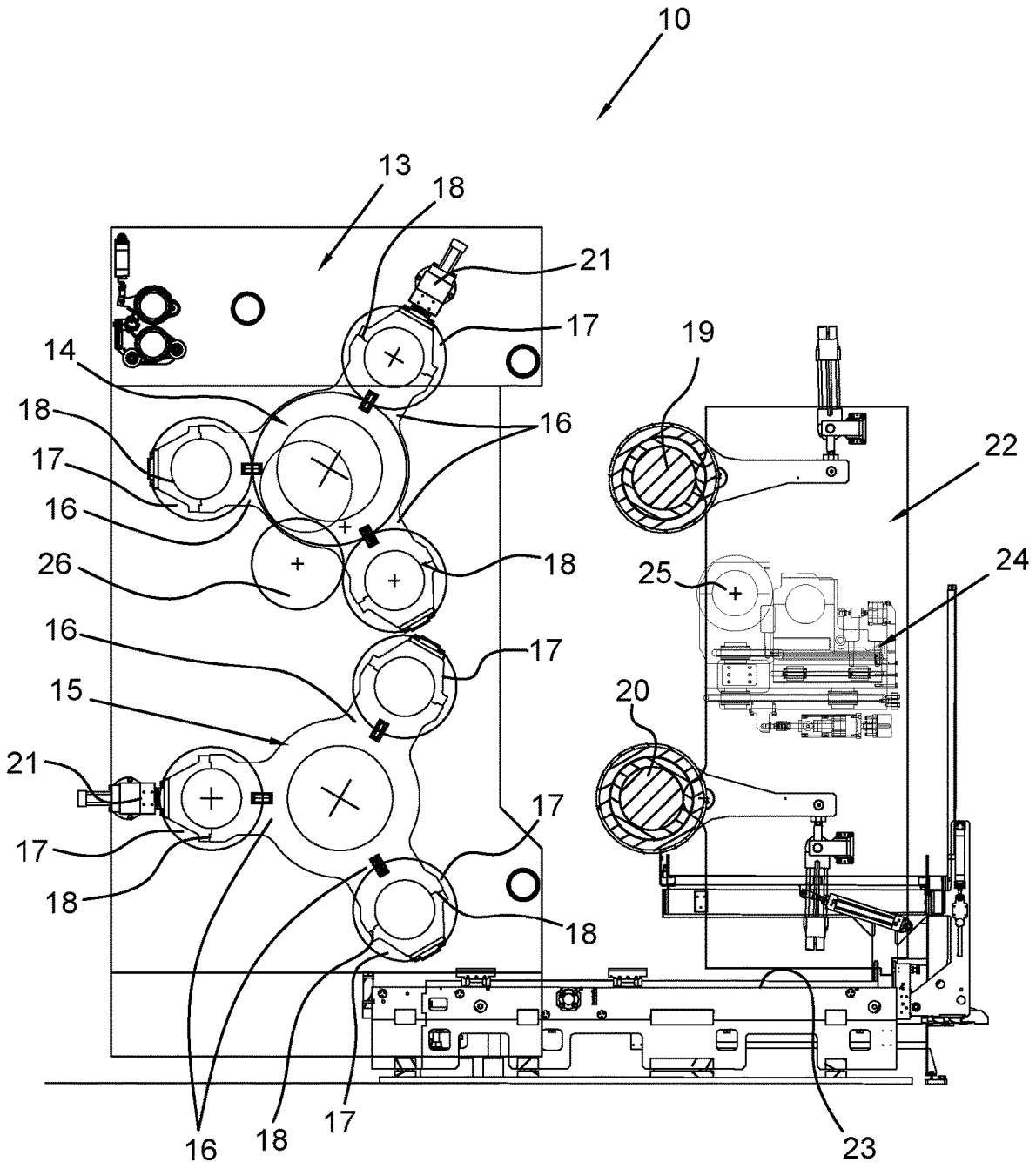
FIG. 2 shows the embossing group of FIG. 1 in open machine configuration.

With reference to the figures, an embossing group with interchangeable rollers is shown, overall indicated with 10, operating on two plies of tissue paper 11, 12, respectively fed to the embossing group from above and below and indicated in FIG. 1 with interrupted section and with continuous section.

The embossing group 10 carries on a frame, indicated in its parts 13, pairs of arrangements such as those illustrated in the figure, so as to support the ends of the rollers that compose it. For simplicity's sake, therefore, only one side is referred to in the description.

The frame 13 provides, on each side, two rotating supports 14, 15 with three arms 16. Each arm 16 of each of the two rotating supports 14, 15 supports one end of a steel embossing roller 17.

In particular, the embossing roller 17 is retained at the end of the arm 16 by a locking element 18.

The two rotating supports 14, 15 are constrained to the frame 13, rotating around their own central axis, so that the embossing rollers 17, retained at the ends of the rotating supports 14, 15, describe circular trajectories when the rotating supports 14, 15 are rotated.

The circular trajectories described by the embossing rollers 17 lead the same to have a minimum distance from each other, wherein two embossing rollers 17 mounted respectively on two different pairs of rotating supports 14, 15 are in a position facing each other at an operative position of the embossing rollers 17 for embossing two paper plies 11, 12.

In fact, in the operative position, two embossing rollers 17 are facing each other, constituting a pair of steel embossing rollers, to carry out the relative embossing operations on the corresponding paper ply 11, 12, returned around each of them.

The embossing group comprises two rubber-coated rollers 19, 20 each of which can be coupled to the embossing roller 17 of the pair of embossing rollers placed in the operative position by the rotating support 14, 15.

The rubber-coated rollers 19, 20 are pivoted on a sidewall 22 that can be moved horizontally away from and towards the two three-arm rotating supports 14, 15 by means of a slide 23.

In the operative position, the paper plies 11, 12 are returned in a known manner between each embossing roller 17 and the corresponding rubber-coated roller 19, 20 for performing a traditional embossing at one or more heights, and/or for performing a micro-embossing.

The figures show, by way of example, an embossing-laminating group provided with a laminating unit 24, integral with the slide 23 and comprising a glue group 25 and a coupling roller, called marriage roller, 26 placed next to the embossing roller 17 on the opposite side with respect to the laminating unit 24 which has the standard function of a presser for coupling the plies 11, 12 after the embossing and the distribution of the glue on the upper ply 11.

The marriage roller 26 remains inside the pairs of upper rotating supports 14 during the rotation thereof and therefore does not need to be moved to allow rotation for the replacement of the operative embossing roller 17.

According to the invention, the embossing group 10 could indistinctly be provided or not with the laminating unit 24.

The pair of embossing rollers 17 placed in the operative position may consist of any combination of the three rollers of both rotating supports 14, 15 and is phasable electronically, or in another known manner, if the decorative embossing pattern so requires. It follows that for any combination of embossing rollers 17 in the operative position, a synchronised embossing is possible, for engraving designs that allow it.

A rotation locking device 21 keeps the rotating support 14, 15 in a fixed position during embossing operations and provides stability.

The steel embossing rollers 17 are moved from the operative position to rest positions, in which the rollers 17 are not affected by the embossing operations, by rotation of the rotating supports 14, 15 around their central axis.

Advantageously, the path of the two plies is the same regardless of which of the three pairs of embossing rollers is used. This allows full interchangeability between the steel rollers and maximum flexibility in the use of the embossing group.

Advantageously, the path of the two plies on the pairs of embossing/rubber-coated rollers in the operative position is substantially specular, wrapping both the rubber-coated roller and the steel roller by about 180°. This allows to synchronize the embossing on the upper ply and lower ply to obtain products in phase, in particular for the production of kitchen paper.

Advantageously, three pairs of steel rollers suitable for producing products in phase can be applied.

A further advantage is the reduction in the diameter of the rotating support, which significantly reduces balancing problems if no rollers are loaded on all the three arms of the rotating support.

The embossing group with interchangeable rollers as conceived herein is susceptible to many modifications and variations, all falling within the invention; furthermore, all the details are replaceable by technically equivalent elements. In practice, the materials used, as well as their dimensions, can be of any type according to the technical requirements.

The invention claimed is:

1. An embossing-laminating group with interchangeable rollers for the surface processing of tissue paper, comprising:

a frame bearing three pairs of steel embossing rollers, wherein each pair of rollers is movable between a first operative position for embossing two paper plies and rest positions, as well as comprising two rubber-coated rollers which can be coupled with the pair of embossing rollers placed in the operative position, two pairs of rotating supports, wherein each rotating support is provided with three arms, each arm bearing at the end a locking element for one end of an embossing roller, wherein the ends of the embossing rollers are located at the ends of the arms of the rotating supports and the rotating supports are constrained to the frame and rotate around their own central axis; and a laminating unit and a coupling roller, said coupling roller being located next to an operative position for an embossing roller on an opposite side with respect to the laminating unit.

2. The embossing-laminating group with interchangeable rollers according to claim 1, wherein the embossing rollers at the ends of the arms of the rotating supports describe circular trajectories, and wherein in the operative position of the embossing rollers, two embossing rollers are facing each other, constituting a pair of steel embossing rollers.

3. The embossing-laminating group with interchangeable rollers according to claim 1, wherein the rubber-coated rollers are pivoted on a slide that is configured to move horizontally away from and towards the three-arm rotating supports.

4. The embossing-laminating group with interchangeable rollers according to claim 3, wherein the laminating unit comprises a glue group and is integral with the slide.

5. The embossing-laminating group with interchangeable rollers according to claim 1, wherein each rotating support comprises a rotation locking device.

6. The embossing-laminating group with interchangeable rollers according to claim 2, wherein the rubber-coated rollers are pivoted on a slide that is configured to move horizontally away from and towards the two three-arm rotating supports.

7. The embossing-laminating group with interchangeable rollers according to claim 2, wherein each rotating support comprises a rotation locking device.

8. The embossing-laminating group with interchangeable rollers according to claim 3, wherein each rotating support comprises a rotation locking device.

9. The embossing-laminating group with interchangeable rollers according to claim 6, wherein each rotating support comprises a rotation locking device.

10. The embossing-laminating group with interchangeable rollers according to claim 1, wherein the coupling roller does not need to be moved to allow rotation of the rotating supports.

11. The embossing-laminating group with interchangeable rollers according to claim 1, wherein each of said pairs of embossing rollers do not contact one another when in said operative position.

* * * * *